US007264691B2

(12) United States Patent
Hard

(10) Patent No.: US 7,264,691 B2
(45) Date of Patent: Sep. 4, 2007

(54) FIBROUS SUBSTRATES

(75) Inventor: Steven John Hard, Chippenham, Wiltshire (GB)

(73) Assignee: De La Rue International Limited, Basingstoke (GB)

( * ) Notice: Subject to any disclaimer, the term of this patent is extended or adjusted under 35 U.S.C. 154(b) by 75 days.

(21) Appl. No.: 10/518,507

(22) PCT Filed: Jun. 25, 2003

(86) PCT No.: PCT/GB03/02723

§ 371 (c)(1),
(2), (4) Date: Dec. 20, 2004

(87) PCT Pub. No.: WO04/001130

PCT Pub. Date: Dec. 31, 2003

(65) Prior Publication Data

US 2005/0211403 A1 Sep. 29, 2005

(30) Foreign Application Priority Data

Jun. 25, 2002 (GB) ..... 0214645.4

(51) Int. Cl.
*D21H 21/42* (2006.01)

(52) U.S. Cl. ..... 162/140; 283/57; 283/58; 283/59

(58) Field of Classification Search ..... 162/140; 283/48–53, 57–59, 64.1
See application file for complete search history.

(56) References Cited

U.S. PATENT DOCUMENTS 2,956,331 A * 10/1960 Whitehead ..... 428/193
4,186,943 A 2/1980 Lee
4,462,866 A * 7/1984 Tooth et al. ..... 162/103
4,830,268 A * 5/1989 Pitts ..... 229/67.1
5,093,184 A * 3/1992 Edwards ..... 428/195.1
5,127,677 A * 7/1992 Merry ..... 283/92
5,199,744 A 4/1993 Shenton
5,405,500 A 4/1995 Knight
5,486,022 A * 1/1996 Crane ..... 283/83
5,573,639 A 11/1996 Schmitz et al.
5,688,587 A * 11/1997 Burchard et al. ..... 442/330
5,783,275 A 7/1998 Muck et al.
5,910,058 A * 6/1999 Zheng ..... 473/481
5,961,432 A 10/1999 Murakami et al.
6,355,140 B1 3/2002 Murakami et al.

FOREIGN PATENT DOCUMENTS

EP 0059056 A1 * 9/1982
EP 1114893 7/2001
EP 1114893 A1 * 7/2001
GB 1604463 12/1981
GB 2204532 11/1988
GB 2204532 A * 11/1988
WO WO 00/39391 * 7/2000

* cited by examiner

*Primary Examiner*—Eric Hug
*Assistant Examiner*—Dennis R Cordray
(74) *Attorney, Agent, or Firm*—Dykema Gossett PLLC

(57) ABSTRACT

A fibrous security substrate for use in producing documents includes at least one aperture extending therethrough and contains an elongate impermeable element at least partially embedded therein such that at least one edge thereof is exposed in the aperture.

18 Claims, 5 Drawing Sheets

FIBROUS SUBSTRATES

This application is a 371 of PCT/GB03/02723, filed Jun. 25, 2003 which claims priority of United Kingdom Patent document 0214645.4, filed Jun. 25, 2002.

BACKGROUND OF THE INVENTION

1. Field of the Invention

The invention relates to improvements in methods of making fibrous substrates, and in particular to such substrates containing an elongate impermeable element which can be easily verified through an aperture in the substrate.

2. The Prior Art

It is generally known to include elongate security elements in security paper, as a security feature. Such elements can be threads, strips or ribbons of, for example, plastics film, metal foil, metallised plastic, metal wire. These security elements are included in the thickness of security paper to render imitation of documents produced from the paper more difficult. These elements help in the verification of security documents as they render the view of the documents in reflected light different from that in transmitted light. To increase the security provided by the inclusion of such an elongate element, it is also known to endow the element itself with one or more verifiable properties over and above its presence or absence. Such additional properties include magnetic properties, electrical conductivities, the ability to absorb x-rays and fluorescence.

As a further security feature, it has been found to be particularly advantageous to provide windows in one side of the surface of the paper, which expose such elongate elements at spaced locations. Examples of methods of manufacturing such paper incorporating security elements with or without windows are described below. It should be noted that references to "windowed thread paper" include windowed paper incorporating any elongate security element.

EP-A-0059056 describes a method of manufacture of windowed thread paper on a cylinder mould paper-making machine. The technique involves embossing the cylinder mould cover and bringing an impermeable elongate security element into contact with the raised regions of an embossed mould cover, prior to the contact entry point into a vat of aqueous stock. Where the impermeable security element makes intimate contact with the raised regions of the embossing, no fibre deposition can occur. After the paper is fully formed and couched from the cylinder mould cover, the water is extracted from the wet fibre mat and the paper is passed through a drying process. In the finished paper the contact points are present as exposed regions which ultimately form windows, visible in reflected light, on one side of a banknote paper.

WO-A-93/08327 describes a method of manufacturing windowed thread paper on a Fourdrinier paper-making machine. A rotating embedment means, with a modified profile for embossing, is used to drive an impermeable elongate security element into draining paper stock, on a Fourdrinier wire. The profile of the embedment means is such that raised portions are provided which remain in contact with the security element during the embedment process. Thus, paper fibres are prevented from collecting between the security element and embedment means, such that the security element is subsequently exposed in windowed regions of paper.

The aforementioned processes enable paper to be manufactured in which the security element is exposed in windows in one surface of the paper, or in windows in both surfaces at alternating positions, or to form apertures whereby the windows on the front of the document are in register with those on the back. In order for a user to confirm the security element is continuous and running within the paper they must view the paper in transmitted light. However, users frequently tear the paper in the region of the security element to determine its presence, rather than viewing it in transmission. As a result documents containing security elements are commonly prematurely and deliberately damaged.

The object of the present invention is to provide a security substrate incorporating an elongate security element in which the elongate element is very easily verifiable from both sides of the substrate in apertures which extend through the substrate.

SUMMARY OF THE INVENTION

The invention therefore provides a substrate having an elongate element partially embedded therein and at least one discrete aperture extending through the fibrous substrate exposing at least a part of the elongate element, wherein at least one edge of the elongate element is exposed in the aperture(s).

The invention also provides a method of making a fibrous substrate having an elongate element partially embedded therein, comprising the steps of providing drainage restriction areas on a porous support surface, depositing fibres on to the porous support surface around the drainage restriction areas to form a first layer, bringing the elongate element to lie in contact with the drainage restriction areas of the support surface, and depositing further paper fibres over the first layer to securely embed segments of the elongate element within the substrate between the drainage restriction areas, said drainage restriction areas being such as to substantially prevent the deposition of fibres thereon before and after the elongate element is laid thereover and to thereby form at least one discrete aperture extending through the fibrous substrate, wherein at least one edge of the elongate element is exposed in the aperture(s).

Preferred embodiments of the present invention will now be described, by way of example only, with reference to the accompanying drawings.

DETAILED DESCRIPTION OF THE PREFERRED EMBODIMENTS

Figure 1:
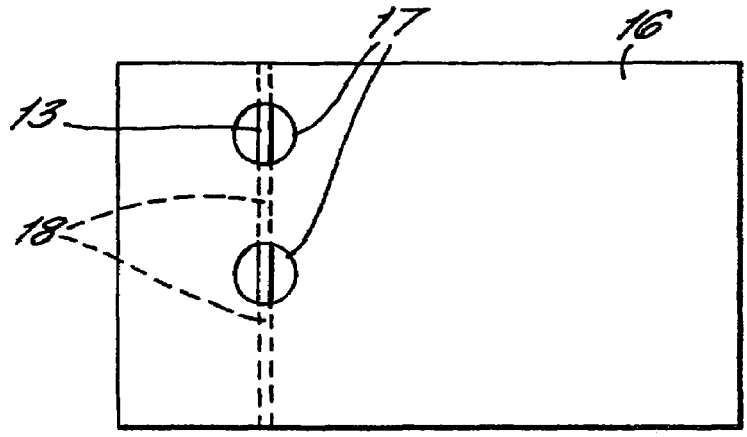
FIG. 1 is a plan view of a security document made from a substrate according to the present invention.

The fibrous substrate 16 according to the present invention is illustrated in FIG. 1 and comprises an elongate security element 13 partially embedded within the substrate 16, having one or more apertures 17 extending through the substrate 16 exposing short lengths of the security element 13. In other embodiments of the invention, for example as shown in FIGS. 8, 9, 10 and 12, the width and/or the positioning of the security element 13 is such that only one edge of the element 13 is exposed in the aperture(s) 17.

The method of manufacturing a security substrate according to the present invention is illustrated firstly with reference to FIGS. 2 to 7. A porous support surface, for example in the form of a cylinder mould cover 10, is produced in a known way. The mould cover 10 has a plurality of drainage restriction regions 12. These can, for example, be provided by fixing a blinding material to the mould cover 10. The blinding material is typically a metal which is welded to the cylinder mould cover 10 (see FIG. 3). Other suitable blind materials are wax, polymer or any other material which can be securely attached to the cylinder mould cover 10 to prevent drainage of water from fibrous stock 11 and hence fibre deposition. These drainage restriction regions 12 define the shape of the apertures 17 formed in the final substrate 16.

Figure 2:
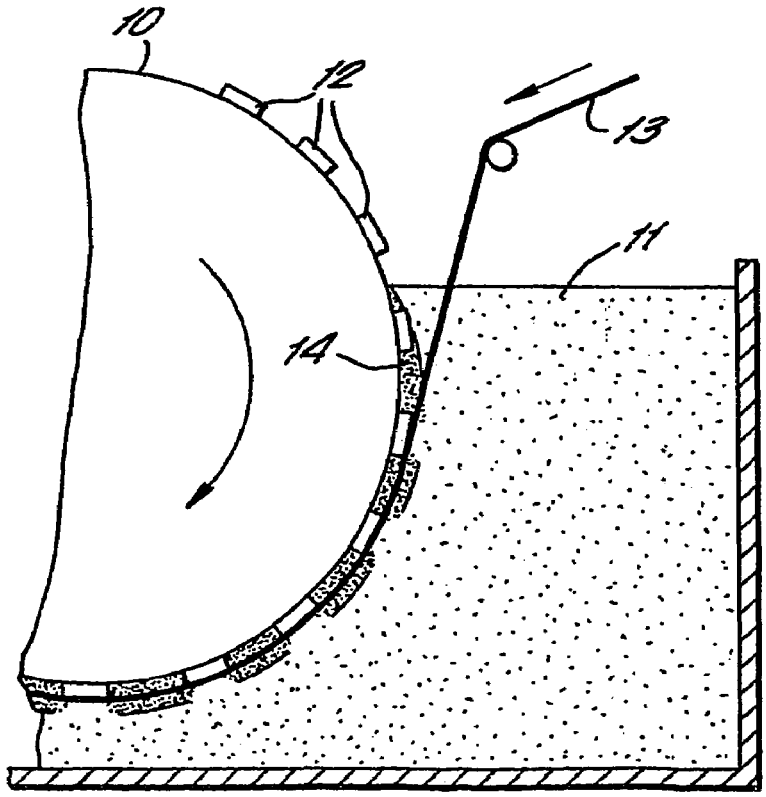
FIGS. 2 to 7 are cross-sectional side elevations of steps involved in the method of making a fibrous substrate according to the present invention.
Figure 3:
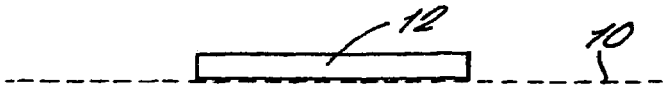
Figure 4:
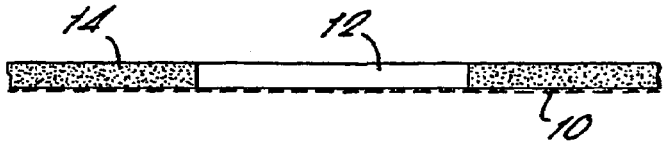
Figure 5:
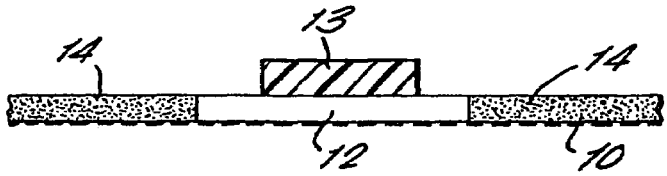
Figure 6:
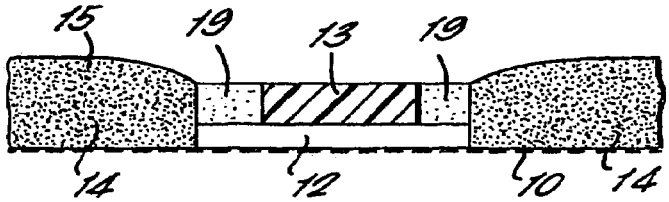
Figure 7:
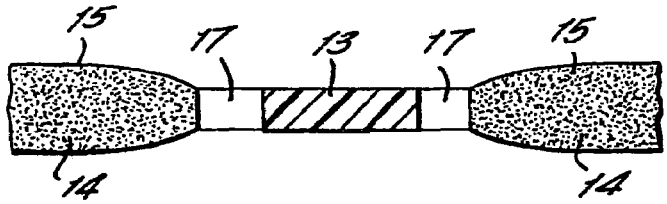
Figure 8:
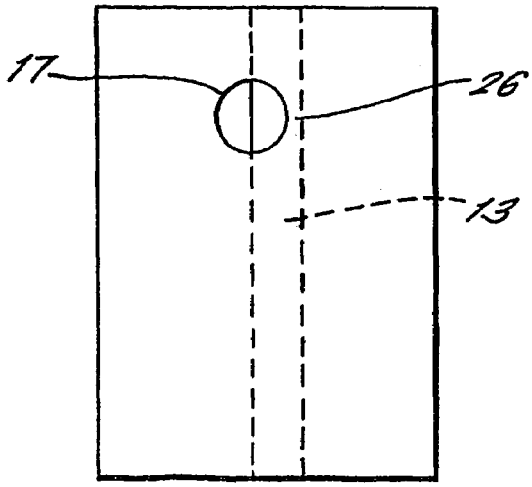
FIGS. 8, 9, and 11 to 13 are plan views of alternative embodiments of the substrate of FIG. 1.

In a known manner, the cylinder mould cover 10 is rotated in a vat of fibrous stock 11 as illustrated in FIG. 2. As it rotates, an elongate security element 13 is brought into contact with the cylinder mould cover 10 below the level of the fibrous stock 11. This means that a layer 14 of fibres has already been deposited onto the cylinder mould cover 10 to form, say, a 40 gsm sheet (see FIGS. 4 and 5). Once the security element 13 is brought into contact with the drainage restriction regions 12, further fibres 15 are deposited on top of the layer 14 to form the remainder of the substrate 16 to, typically, 80 to 90 gsm (see FIGS. 5 and 6). It should of course be noted that in packaging applications the substrates used can have much higher grammages, for example in the order of 250 gsm.

The positioning of the security element 13, with respect to the drainage restriction regions 12 must be determined in the context of whether the element 13 is to be wholly or partly exposed in the apertures 17 (i.e. one edge or both) and this may be affected by the width of the element 13 also.

Figure 9:
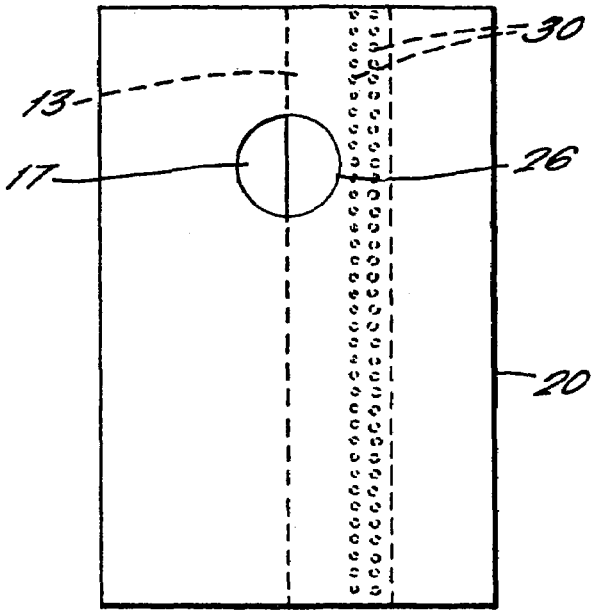
Figure 10:
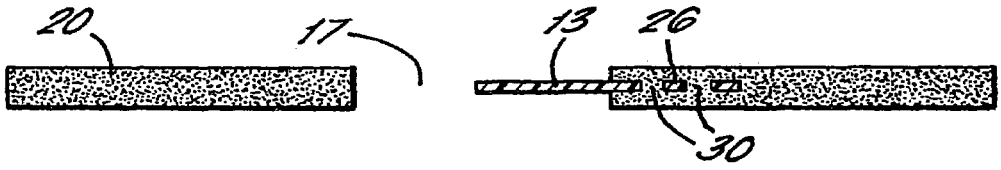
FIG. 10 is a cross sectional side elevation of the substrate of FIG. 9.

The security element 13 may be impermeable, if it is to be exposed along both of its edges as shown in FIG. 1. However it may have a permeable portion 30, as shown in FIGS. 9 and 10, if the element 13 is to have only one edge exposed and the element 13 is relatively wide as compared with the width of the aperture 17. The permeable portion 30 helps to anchor the element 13 within the substrate 16. Alternatively, a layer of adhesive may be provided on the element 13 instead of the permeable portion 30, to assist in anchoring it within the substrate 16.

The security element 13 preferably has-a width of at least 0.5 mm, and more preferably in the range of 0.5 mm to 6 mm, and more preferably in the range of 0.5 mm to 2 mm.

Thus, as mentioned above, a layer of fibres is laid down on the cylinder mould cover 10 prior to the introduction of the security element 13. However, whilst the drainage restriction regions 12 would retain little or no covering of paper fibres before the elongate element 13 is brought into contact therewith, full coverage is obtained in the surrounding areas between the drainage restriction regions 12. Equally, because of the impermeable nature of the elongate element 13 and the drainage restriction regions 12, there is little or no covering of fibres retained over the area occupied by the drainage restriction regions 12, after the element 13 has been brought into contact. During the formation of the apertures 17, some fibres may deposit in the gaps on either side of the elongate element 13 which is narrower than the width of the drainage restriction regions 12 (designated by numeral 19 in FIG. 6). However because of the drainage restriction regions 12, the substrate 16 cannot properly form in the region 19. If required, any such unwanted fibres may be removed during subsequent processing steps.

Thus, when the substrate 16 is removed from the cylinder mould cover 10 (see FIG. 7), whilst the substrate 16 incorporates the elongate element 13, the elongate element 13 is exposed in apertures 17 extending through the substrate corresponding to the drainage restriction regions 12. Segments 18 of the elongate element 13, between the apertures 17, are wholly embedded within the substrate 16.

In a modification of the present invention, the cylinder mould cover 10 is produced in a known way, using dies to form the wire by embossing to form one or more raised areas, which define the shape of the apertures 17 in the final substrate 16. The peaks of the raised areas are then provided with drainage restriction regions 12 to form the apertures 17.

One preferred material for the element 13 is a PET strip of, say, 50 microns thickness as this would help to maintain the "bulk" of the paper 16 over the windowed region. However, other materials such as OPP, PE or PET with other thicknesses may be used. Typically anything from 12 microns upwards can be used.

Figure 11:
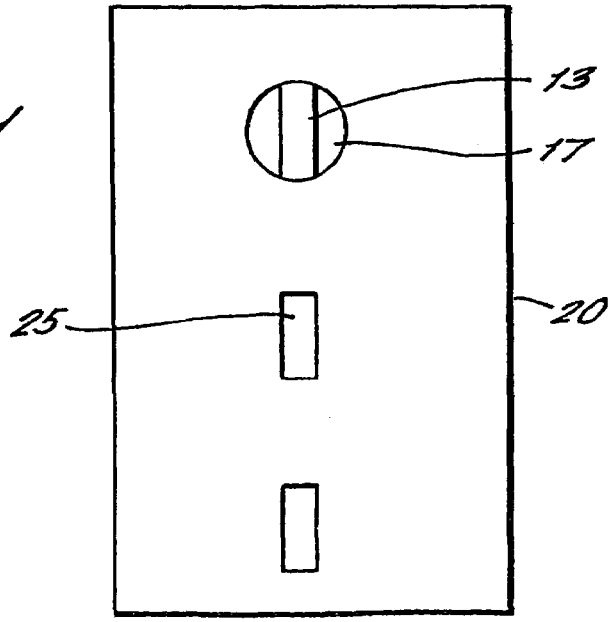
Figure 12:
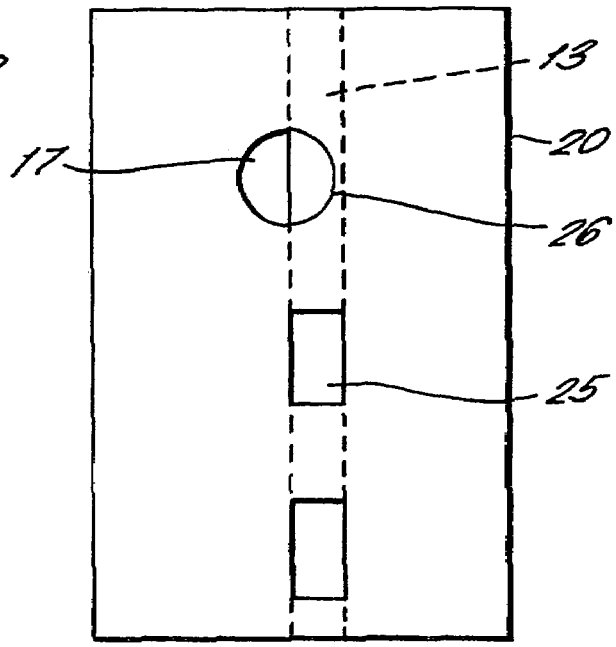

Alternative embodiments of the invention is illustrated in FIGS. 11 and 12, in which the apertures 17 are used in conjunction with traditional windows 25, as described in EP-A-0059056, EP-A-0229645 and EP-A-0625431, in which neither edge of the security element 13 is exposed. FIG. 11 shows both edges of the element 13 exposed in an aperture 17, whilst FIG. 12 shows only one of its edges exposed.

The elongate element 13 may be used as a display surface for indicia, for example de-metallised images, holographic images, colour-shifting areas, print or combinations of any or all of these which are highly visible in the apertures 17. The element 13 may include different security features along its length, such that a different feature can be seen in consecutive apertures 17.

When viewed from either side of the substrate 16, the security element 13 itself can be seen in the apertures 17 as a transparent, shiny, coloured or metallised area which may bear indicia, information and/or imagery. More specific examples include the following:

- de-metallised security elements 13, which may comprise areas of substantially removed metal to take advantage of the transparency of the base film and provide a large area of transparency in the aperture 17;
- holographic security elements 13, which could comprise areas of full metal and half-tone screens to provide partial transparency and/or no metal. Under certain viewing conditions, with no metal, a holographic image is still visible in the aperture 17. Coatings, such as ZnS, having a high refractive index may also be used instead of metal as the reflection enhancing layers. These coatings are essentially transparent;
- security elements 13 with front to back print registration, in which features are printed which would clearly exhibit Moiré patterns from both front and back if a counterfeit were attempted. Alternatively, such patterns could be produced on a transparent film prior to insertion of the security element 13 into the paper as a security feature itself. The exact reproduction of such patterns are very difficult to mimic;

security elements 13 with different coloured print showing on the front to the back. The print may be on either side of the security element 13 or both on the same side, with one colour hidden by the other on one side but showing through on the other side;

security elements 13 comprising or having coatings of liquid crystal, colourshift, thermochromic, photochromic, and iridescent materials to exhibit colour changes within the apertures;

security elements 13 comprising or having coatins of luminescent or magnetic materials;

security embossing of a transparent film forming the base of the security element 13 with a security design (e.g. a latent images such as those disclosed in EP-A-433330) created during the printing process. These may be blind embossed to produce a tactile/visible feature or could include printing inks to further enhance visibility;

security elements 13 have, a matt coating of a similar; colour to the substrate, such that it is only visible in the apertures 17 or any windows 25;

The paper 16 described above can be cut and printed to make all forms of documents, including security documents such as banknotes, cheques, travellers cheques, identity cards, passports, bonds etc or non-security documents such as stationary, labels etc.

Figure 13:
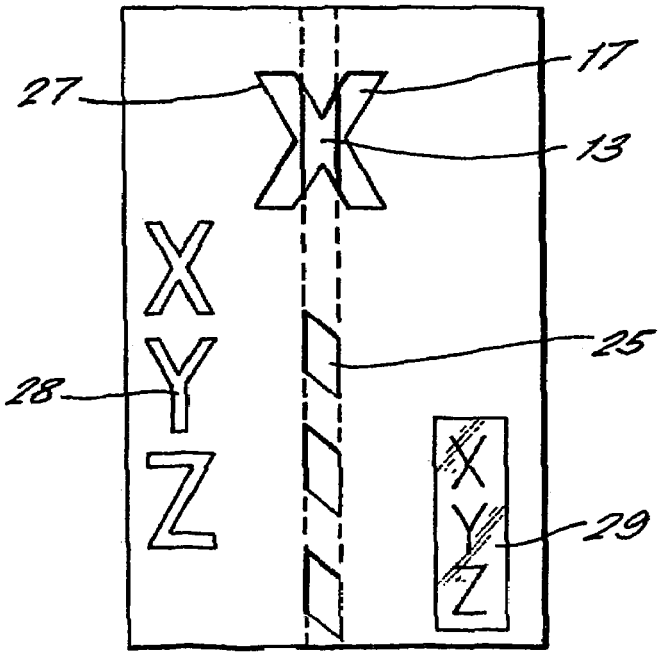
Figure 14:
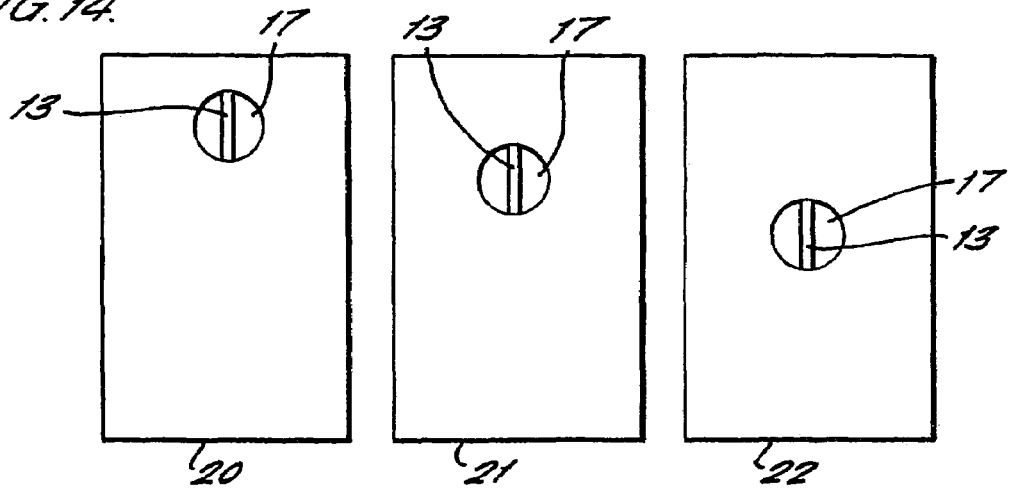
FIG. 14 is a plan view of pages cut from the substrate of FIG. 1 to be used to provide a booklet.

The positioning of the apertures 17, and therefore the design of the drainage restriction regions 12, can be such that when a continuous sheet of fibrous substrate 16 is finished and cut to form discrete sheets, each discrete sheet may have one or a plurality of apertures 17 therein. Within each aperture 17 the security element 13 can clearly be seen extending from one side to the other of the apertures 17 (in the machine direction of the paper). The apertures 17 may be circular as illustrated in the accompanying drawings, or any other shape, for example as shown in FIG. 13. The apertures 17 may also define characterising information, such as indicia, logos or the like. The shape of the apertures 17 may also relate to information elsewhere on the document, such as print and/or security devices.

Where sheets made from the substrate 16 are intended to be used in the form of a booklet, for example as pages of a passport, the sheets may be cut to include a single aperture 17 on each sheet, but at staggered positions. When the sheets are bound together in the booklet, flicking through the pages at a reasonable speed would give the impression of an aperture moving and therefore provides a simple form of verification. This is illustrated in FIG. 14 with three pages 20, 21 and 22, which will be bound together along the left hand edges. Any missing pages would clearly show the aperture movement out of sequence and therefore provide an anti-tamper feature.

The security element 13 may also be used as part of a self authenticating feature, such as those described in EP-A-0930979 or EP-A-0256176.

Figure 15:
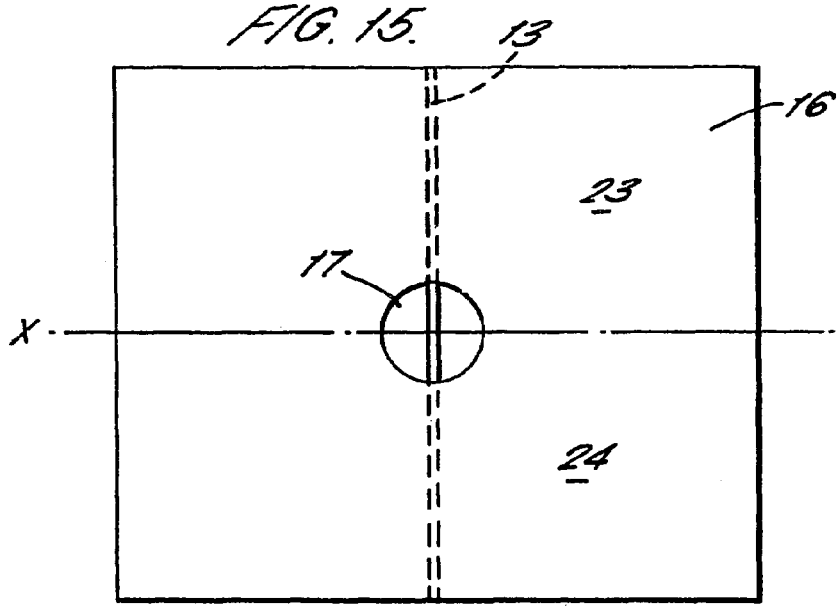
FIG. 15 is a plan view of a sheet of the substrate made by the present invention to be cut into smaller sheets; and therefor.
Figure 16:
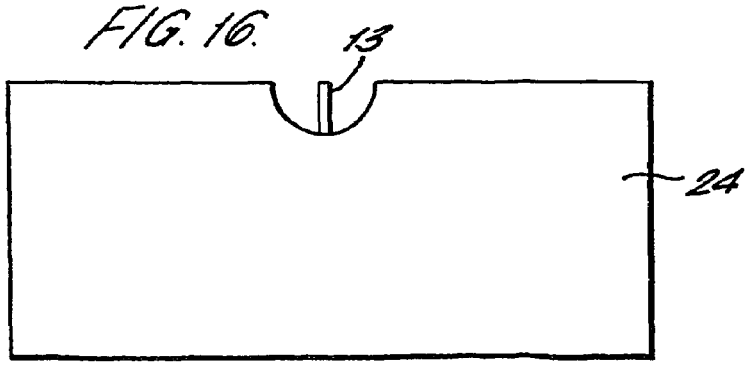
FIG. 16 is a plan view of a sheet cut from the subsrate of FIG. 15.

The substrate 16 may also be cut in a manner which provides half an aperture 17 along one or more edges of a discrete sheet cut from the substrate 16. As shown in FIG. 15 substrate 16 can be cut into two separate discrete sheets 23, 24 along the line XX. As this cutting line passes through the aperture 17 and elongate element 13, a notch will be left in the edge of each of the sheets 23, 24 in which an end of the elongate element 13 is exposed, as shown in FIG. 16.

The invention claimed is:

1. A fibrous security substrate for producing documents, said fibrous security substrate including an elongate element partially embedded therein and a discrete aperture extending through the fibrous substrate so as to expose at least a part of the elongate element, wherein at least one edge of the elongate element is exposed in the aperture, a gap being formed between the elongate element and a perimeter of the aperture.

2. A substrate as claimed in claim 1 in which the elongate element bears indicia, images or information.

3. A substrate as claimed in claim 1 in which the elongate element is wholly or partially metallised.

4. A substrate as claimed in claim 1 in which the elongate element bears one or more holographic images.

5. A substrate as claimed in claim 1 in which the elongate element has at least one colour shift areas.

6. A substrate as claimed in claim 1 in which the elongate element has at least one security embossing.

7. A substrate as claimed in claim 1 in which the elongate element is printed on one or both sides.

8. A substrate as claimed in claim 1 in which the elongate element bears a liquid crystal material.

9. A substrate as claimed in claim 1 in which at least another part of the elongate element is exposed in one or more windows in at least one surface of the substrate.

10. A document made from a fibrous substrate according to claim 1 comprising at least one aperture.

11. A document as claimed in claim 10 comprising a plurality of apertures.

12. A document as claimed in claim 10 comprising a security document selected from the group consisting of a banknote, a cheque, a travelers cheque, an identity card, a passport and a bond.

13. A document as claimed in claim 10 in which the document is a non-security document selected from the group consisting of an item of stationery and a label.

14. A document comprising a plurality of sheets which are each made from a fibrous substrate according to claim 1, the aperture in each sheet of said plurality of sheets being in register with the aperture in adjacent sheets.

15. A document comprising a plurality of sheets which are each made from a fibrous substrate that has a discrete aperture extending therethrough and has an elongate element partially embedded therein such that at least one edge of the elongate element is exposed in said aperture and a gap is formed between the elongate element and a perimeter of the aperture, the aperture in each sheet of said plurality of sheets being in a location offset with respect to the location of the aperture in adjacent sheets.

16. A document which includes a fibrous security substrate that has a aperture extending therethrough and an elongate element partially embedded therein such that at least one edge of the elongate element is exposed in said aperture and a gap is formed between the elongate element and a perimeter of the aperture, at least a part of the aperture being located along an edge of the document.

17. A method of making a fibrous substrate as claimed in claim 1 having an elongate element partially embedded therein, comprising the steps of providing drainage restriction areas on a porous support surface, depositing fibres on the porous support surface around the drainage restriction areas to form a first layer, bringing the elongate element to lie in contact with the drainage restriction areas of the support surface, and depositing further paper fibres over the first layer to securely embed segments of the elongate element within the substrate between the drainage restriction areas, said drainage restriction areas being such as to substantially prevent the deposition of fibres thereon before and after the elongate element is laid thereover and to thereby form at least one discrete aperture extending through the fibrous substrate, wherein a width of the elongate element is less than a maximum width of the aperture(s).

18. A method as claimed in claim 17 further comprising the step of forming at least one window in at least one surface of the substrate in which a portion of the elongate element, not including either of its edges, is exposed.

* * * * *